US012004657B2

(12) United States Patent
Jin

(10) Patent No.: US 12,004,657 B2
(45) Date of Patent: Jun. 11, 2024

(54) AUTOMATIC FOLDING CHAIR

(71) Applicant: Yichen Jin, Zhejiang (CN)

(72) Inventor: Yichen Jin, Zhejiang (CN)

( * ) Notice: Subject to any disclaimer, the term of this patent is extended or adjusted under 35 U.S.C. 154(b) by 117 days.

(21) Appl. No.: 17/962,973

(22) Filed: Oct. 10, 2022

(65) Prior Publication Data

US 2024/0090669 A1 Mar. 21, 2024

(30) Foreign Application Priority Data

Sep. 21, 2022 (CN) ..... 202222498250.5

(51) Int. Cl.
*A47C 4/28* (2006.01)

(52) U.S. Cl.
CPC ..... *A47C 4/286* (2013.01)

(58) Field of Classification Search
CPC ..... A47C 4/286
See application file for complete search history.

(56) References Cited

U.S. PATENT DOCUMENTS 4,258,951 A * 3/1981 Groom ..... A47C 4/286 297/16.2
2012/0104805 A1* 5/2012 Lah ..... A47C 4/286 297/16.1
2013/0313865 A1* 11/2013 Homans ..... A47C 4/286 297/16.1
2014/0346818 A1* 11/2014 Yang ..... A47C 4/286 297/16.2

FOREIGN PATENT DOCUMENTS

CN 209377122 U * 9/2019 ..... A47C 4/286
CN 210902218 U * 7/2020 ..... A47C 4/286
WO WO-2016055280 A1 * 4/2016 ..... A47C 4/286

* cited by examiner

*Primary Examiner* — Anthony D Barfield

(57) ABSTRACT

The invention discloses an automatic folding chair, comprising: a chair seat and a folding chair frame, wherein the folding chair frame comprises an automatic folding assembly, a rear supporting seat, and two front supporting seats symmetrically arranged on the left and the right; the automatic folding assembly comprises an adapter, a telescopic rod, and second connecting rods; the telescopic rod is further provided with a self-locking piece, and the self-locking piece has a locked state and an unlocked state; in the locked state, the self-locking piece can restrict the telescopic rod to expand and contract, which can improve the stability of the chair; in the unlocked state, the telescopic rod can actively expand and contract, which can simplify the user's operation and improve the convenience of use.

9 Claims, 8 Drawing Sheets

AUTOMATIC FOLDING CHAIR

1. TECHNICAL FIELD

The invention relates to the technical field of seats, in particular to a novel automatic folding chair.

2. BACKGROUND ART

Folding chairs are widely used in outdoor activities because of their compact storage volume and light weight. For example, the patent application number CN202121835438.3 discloses a folding space chair, which comprises a folding support frame and a chair cover, one side of a rear support block is provided with a sunken groove, two connecting rods are movably mounted in the sunken groove through rivets, and one ends of the two connecting rods are respectively and fixedly connected with two front support blocks in an inserting manner; two arc-shaped rods are movably installed at the two ends of the interior of the C-shaped body, and one ends of the two arc-shaped rods are movably hinged to the two front supporting blocks correspondingly. Supporting legs are inserted into the bottoms of the front supporting block and the rear supporting block, a front supporting rod is obliquely inserted into the upper end of the front supporting block, rear supporting rods are obliquely inserted into the two sides of the top of the rear supporting block respectively, sleeve blocks are fixedly connected to the backs of the four corners of the chair sleeve, and the ends of the rear supporting rod and the front supporting rod are sleeved with the four sleeve blocks respectively.

This scheme has the following disadvantages: 1. the necessary direct connection structure is lacking between the C-shaped body and the rear support block; when the front leg of the chair applies a rated thrust (such as the foot root or calf accidentally touches), the C-shaped body is easy to change the angle backward, and the arc rods on both sides change the angle backward, and the lateral support force is weakened, which may cause the chair to be folded, so the structure when unfolded is not stable enough, posing a safety hazard; 2. when folding, manpower is required to push the C-shaped body backward, and automatic folding cannot be realized; the folding process is not simple and convenient, so it needs to be improved.

3. SUMMARY OF THE INVENTION

The invention aims to solve at least one of the technical problems existing in the prior art. In view of this, the purpose of the invention is to provide a new type of automatic folding chair.

The technical solutions of the invention are: a new type of automatic folding chair, comprising: a chair seat and a folding chair frame, wherein the folding chair frame comprises an automatic folding assembly, a rear supporting seat, and two front supporting seats symmetrically arranged on the left and the right;

the rear supporting seat is rotatably connected with two first connecting rods, and the two first connecting rods are fixedly connected to the two front supporting seats respectively; the rear supporting seat and the front supporting seats are detachably inserted with a foot rod and a supporting rod, and the supporting rod and the chair seat are detachably connected;

the automatic folding assembly comprises an adapter, a telescopic rod, and second connecting rods; the adapter is located between the two front supporting seats; the left and right sides of the adapter are respectively rotatably connected with the second connecting rods, and the two second connecting rods are rotatably connected to the two front supporting seats one by one;

the telescopic rod is an elastic rod that can be axially elongated under external force, axially contracted under its own internal force, or axially contracted under external force, and axially elongated under its own internal force; one axial end of the telescopic rod is fixedly connected to the rear supporting seat, and the other axial end thereof is fixedly connected to the adapter; the telescopic rod is further provided with a self-locking piece, and the self-locking piece has a locked state and an unlocked state; in the locked state, the self-locking piece can restrict the telescopic rod to expand and contract; in the unlocked state, the telescopic rod can actively expand and contract.

Preferably, the front side of the rear supporting seat is provided with first grooves, and the first groove is provided with a first rotating shaft; the rear side of the front supporting seat is provided with first inserting holes; one end of the first connecting rod is inserted into the first groove and is rotatably connected to the first rotating shaft, and the other end thereof is fixedly inserted into the first inserting holes.

Preferably, the upper side of the rear supporting seat is provided with second inserting holes for inserting the supporting rod, and the lower side of the rear supporting seat is provided with third inserting holes for inserting the foot rod; the upper side of the front supporting seat is provided with fourth inserting holes for inserting the supporting rod, and the lower side of the front supporting seat is provided with fifth inserting holes for inserting the foot rod.

Preferably, a spring wire is connected between the supporting rod and the rear supporting seat, between the supporting rod and the front supporting seat, between the foot rod and the rear supporting seat, and between the foot rod and the front supporting seat.

Preferably, the left and right sides of the adapter are respectively provided with second grooves, and the front supporting seat is provided with third grooves; the second groove is provided with a second rotating shaft, and the third groove is provided with a third rotating shaft; one end of the second connecting rod is inserted into the second groove and is rotatably connected to the second rotating shaft, and the other end thereof is inserted into the third groove and is rotatably connected to the third rotating shaft.

Preferably, the telescopic rod comprises a first outer tube body, a first inner tube body, and an elastic piece; one of the first outer tube body and the first inner tube body is fixedly connected to the rear supporting seat, and the other is fixedly connected to the adapter; the first inner tube body is inserted into the first outer tube body; one end of the elastic piece is fixedly connected to the first inner tube body, and the other end thereof is fixedly connected to the first outer tube body;

the self-locking piece is a first spring buckle; the first outer tube body is provided with a first limiting hole, and the first inner tube body is provided with the first spring buckle; the first spring buckle can be snapped into the first limiting hole and the first spring buckle can be pressed to disengage from the first limiting hole.

Preferably, the chair seat is provided with a sleeve, and the supporting rod is detachably inserted into the sleeve.

Preferably, the supporting rod on the rear supporting seat is a splicing rod.

Preferably, the foot rod is a telescopic piece.

Compared with the prior art, the invention has the following advantageous effects:

The chair of the invention adopts an automatic folding assembly to connect the front and rear supporting seats, and the automatic folding assembly has a locked state and an unlocked state. In the locked state, the automatic folding assembly will be locked and unable to move, which can improve the stability of the chair and ensure the overall safety and physical pressure bearing capacity of the chair; in the unlocked state, the automatic folding assembly will automatically fold, which can simplify the user's operation and improve the convenience of use; with the detachable supporting rod and foot rod, it can finally be folded into a smaller storage volume, which improves portability.

Additional aspects and advantages of the invention will be set forth in part hereinafter, and in part will be apparent from the following description, or learned by practice of the invention.

4. BRIEF DESCRIPTION OF ACCOMPANY DRAWINGS

In order to explain the embodiments of the invention or the technical solutions in the prior art more clearly, the drawings that need to be used in the description of the embodiments or the prior art will be introduced hereinafter. Obviously, the drawings in the following description are only some embodiments of the invention. For those of ordinary skill in the art, other drawings may be obtained from these drawings without creative efforts.

Figure 1:
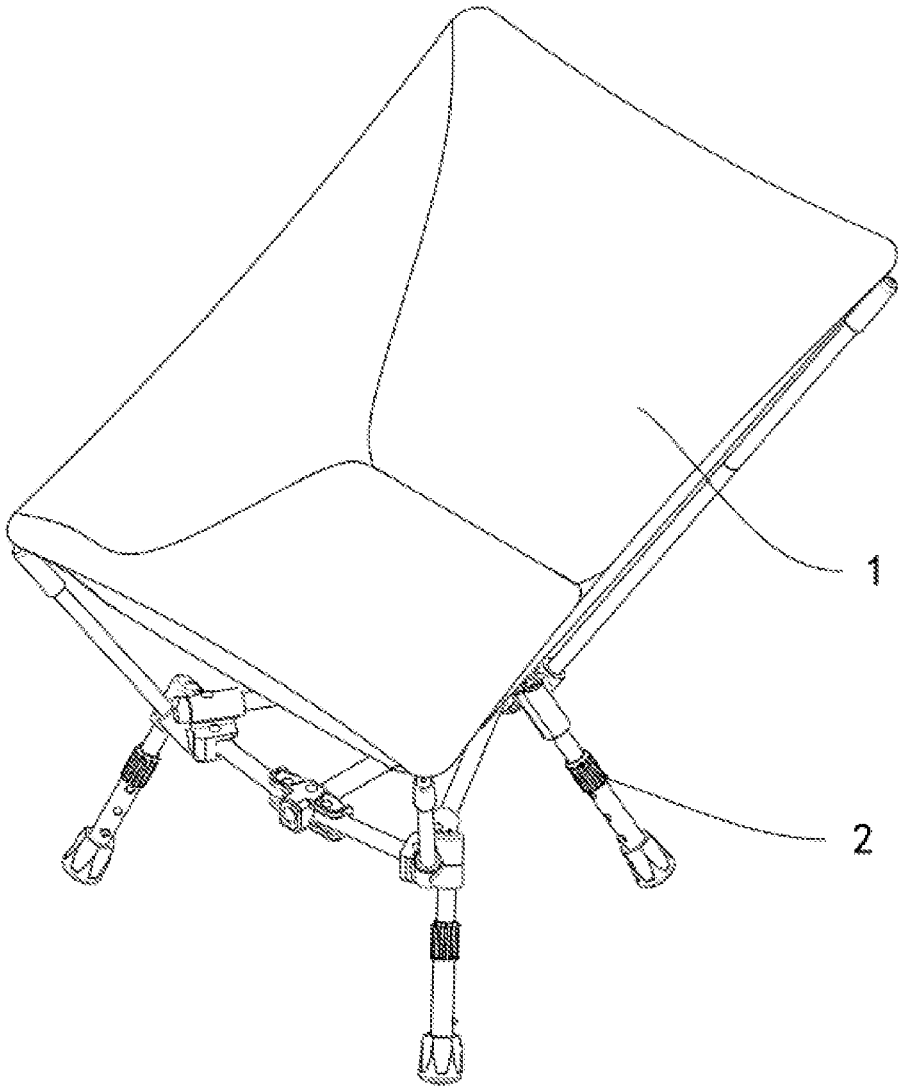
FIG. 1 is a perspective view of the invention.

The Reference Numbers are as Follows:

1 refers to the chair seat;

2 refers to the folding chair frame;

21 refers to the rear supporting seat; 211 refers to the first groove; 212 refers to the first rotating shaft; 213 refers to the second inserting hole; 214 refers to the third inserting hole;

22 refers to the front supporting seat; 221 refers to the first inserting hole; 222 refers to the fourth inserting hole; 223 refers to the fifth inserting hole; 224 refers to the third groove; 225 refers to the third rotating shaft;

23 refers to the first connecting rod;

24 refers to the supporting rod; 241 refers to the inserting part;

25 refers to the foot rod; 251 refers to the second inner tube body; 252 refers to the second outer tube body; 253 refers to the second spring buckle; 254 refers to the second limiting hole; 255 refers to the non-slip mat;

26 refers to the automatic folding assembly; 261 refers to the adapter; 2611 refers to the second groove; 2612 refers to the second rotating shaft; 262 refers to the telescopic rod; 2621 refers to the first outer tube body; 2622 refers to the first inner tube body; 263 refers to the second connecting rod; 264 refers to the self-locking piece;

27 refers to the spring wire.

5. SPECIFIC EMBODIMENT OF THE INVENTION

In order to make the objectives, technical solutions, and advantages of the embodiments of the invention clearer, the technical solutions in the embodiments of the invention will be described clearly and completely hereinafter with reference to the drawings in the embodiments of the invention. Obviously, the described embodiments are part of the embodiments of the invention, rather than all of the embodiments. Based on the embodiments of the invention, all other embodiments obtained by those of ordinary skill in the art without creative work shall all fall within the protection scope of the invention.

The embodiments of the invention are described in detail hereafter. Examples of the embodiments are shown in the accompanying drawings, in which the same or similar reference numerals indicate the same or similar elements or elements with the same or similar functions. In the description of the invention, it should be understood that the orientation or positional relationship indicated by the terms "upper", "lower", "front", "back, "left", "right", "inner", "outer", "vertical", "circumferential", "radial", "axial" etc. are based on the orientation or positional relationship shown in the drawings, and is only for the convenience of describing the invention and simplifying the description, but not indicate or imply that the pointed device or element must have a specific orientation, be constructed and operated in a specific orientation, and therefore cannot be understood as a limitation of the invention.

In the description of the invention, "first feature" and "second feature" may include one or more of these features. In addition, the terms "first" and "second" are only used for descriptive purposes, and cannot be understood as indicating or implying relative importance or implicitly indicating the number of indicated technical features. Thus, the features defined with "first" and "second" may explicitly or implicitly include one or more of these features.

In the invention, unless otherwise clearly defined and limited, the terms "installed", "connected", "fixed" and other terms should be interpreted broadly; for example, it can be a fixed connection, a detachable connection or an integral connection; it can be a mechanical connection or an electrical connection; it can be a direct connection or an indirect connection through an intermediary, and it can be a connection between two components. For those of ordinary skill in the art, the specific meanings of the above terms in the invention can be understood according to specific circumstances.

Figure 2:
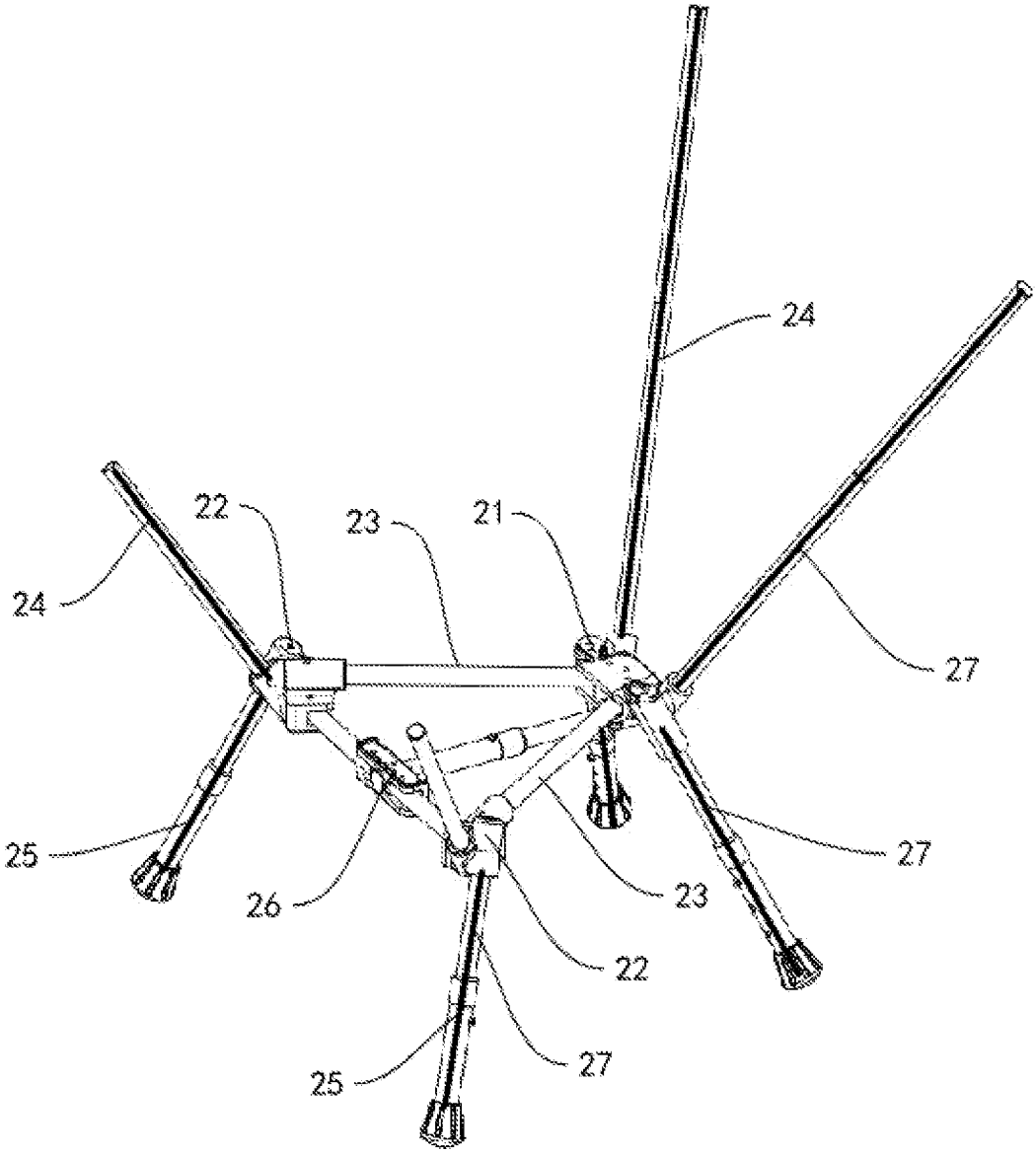
FIG. 2 is a perspective view of the folding chair frame of the invention.

A new type of automatic folding chair as shown in FIG. 1-FIG. 8, comprising: a chair seat 1 and a folding chair frame 2, wherein the folding chair frame 2 comprises an automatic folding assembly 26, a rear supporting seat 21, and two front supporting seats 22 symmetrically arranged on the left and the right;

As shown in FIG. 2, the rear supporting seat 21 is rotatably connected with two first connecting rods 23, and the two first connecting rods 23 are fixedly connected to the two front supporting seats 22 respectively; the rear supporting seat 21 and the front supporting seats 22 are detachably inserted with a foot rod 25 and a supporting rod 24; the foot rod 25 can be supported on a supporting surface such as the ground; the supporting rod 24 and the chair seat 1 are detachably connected, and the supporting rod 24 is used to support the chair seat 1.

The detachable insertion mentioned herein means that the rod body can be inserted or pulled out, so that the detachable connection of the rod body can be realized, and it is convenient to realize folding and assembly.

The automatic folding assembly 26 comprises an adapter 261, a telescopic rod 262, and second connecting rods 263; the adapter 261 is located between the two front supporting seats 22; the left and right sides of the adapter 261 are respectively rotatably connected with the second connecting rods 263, and the two second connecting rods 263 are rotatably connected to the two front supporting seats 22 one by one; the telescopic rod 262 is an elastic rod that can be axially elongated under external force, axially contracted under its own internal force, or axially contracted under external force, and axially elongated under its own internal force; one axial end of the telescopic rod 262 is fixedly connected to the rear supporting seat 21, and the other axial end thereof is fixedly connected to the adapter 261; the telescopic rod 262 is further provided with a self-locking piece 264, and the self-locking piece 264 has a locked state and an unlocked state; in the locked state, the self-locking piece 264 can restrict the telescopic rod 262 to expand and contract; in the unlocked state, the telescopic rod 262 can actively expand and contract.

Specifically, the telescopic rod 262 used in this solution has two forms: one is that it can be axially elongated under external force and axially contracted under its own internal force, with reference to FIG. 3, FIG. 4, FIG. 7 and FIG. 8; since the telescopic rod 262 is provided with a self-locking piece 264, and under the action of the self-locking piece 264, the telescopic rod 262 is in a locked state and cannot be extended or retracted, therefore, the automatic folding assembly 26 cannot act, so that the entire folding chair frame 2 is in a stable state; when the self-locking piece 264 is released to be in an unlocked state, the telescopic rod 262 loses its restraint and can be actively retracted under its own internal force; at this time, the adapter 261 is automatically pulled toward the rear supporting seat 21, and the adapter 261 further pulls the two front supporting seats 22 toward each other through the two second connecting rods 263, thereby realizing the automatic folding and shrinking of the folding chair frame 2; subsequently, the supporting rod 24 and the foot rod 25 can be removed as required.

Another form is that: the telescopic rod 262 is an elastic rod that can be axially contracted under external force and axially elongated under its own internal force; at this time, when the self-locking piece 264 is in a locked state, the telescopic rod 262 can neither be extended nor retracted, so the automatic folding assembly 26 cannot operate either; however, when the self-locking piece 264 is released to be in an unlocked state, the telescopic rod 262 loses its restraint and will actively extend under its own internal force; at this time, the telescopic rod 262 will automatically push the adapter 261 away, and the adapter 261 will then push the two front supporting seats 22 outward through the two second connecting rods 263, so as to realize the automatic folding and unfolding of the folding chair frame 2.

As for which structural form of the telescopic rod 262 to be used, it can be selected according to requirements, which is not limited herein. In the following, the solution will be introduced by taking the example that the telescopic rod 262 performs axial extension under external force and axially shrinks under its own internal force.

Further, in order to improve the stability of the chair frame, in the locked state, the two second connecting rods 263 are parallel and collinear, and the telescopic rod 262 is perpendicular to the second connecting rods 263; at this time, the automatic folding assembly 26 will be in a T shape, which can effectively support and connect the rear supporting seat 21 and the two front supporting seats 22.

The specific structure of each component of the chair will be described in detail hereinafter.

Figure 3:
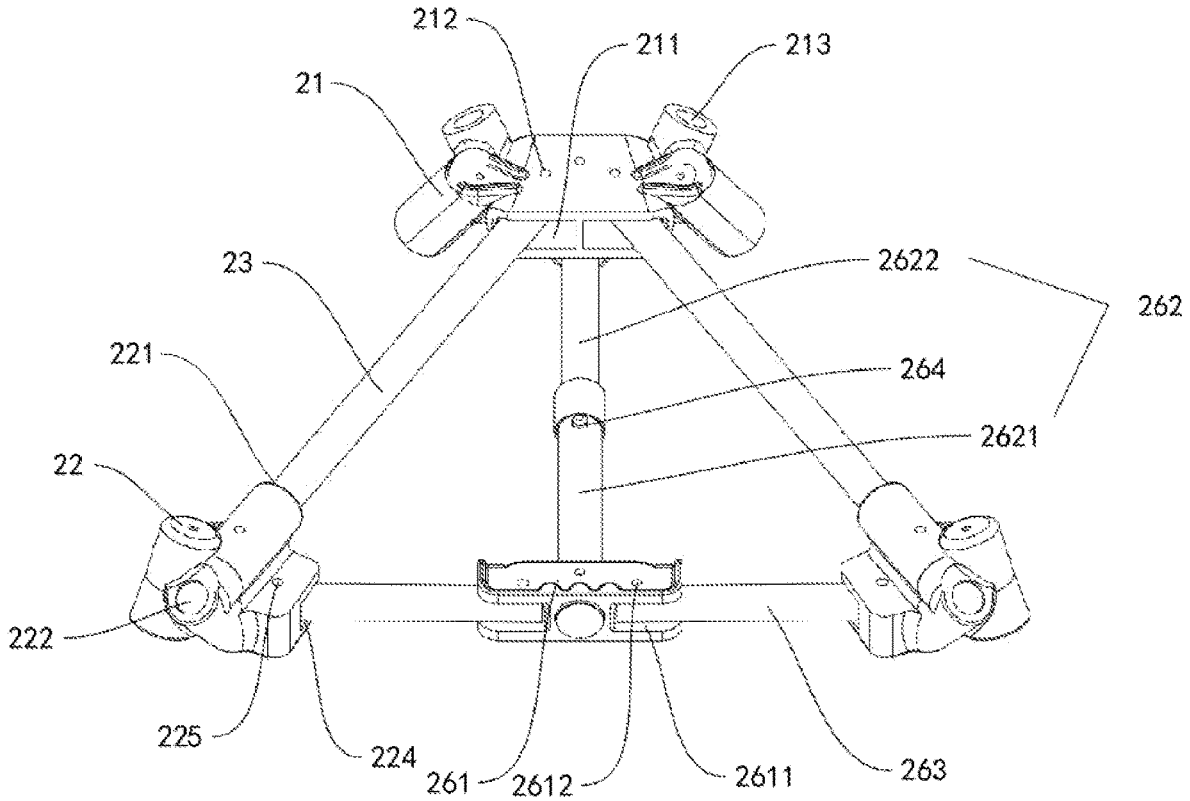
FIG. 3 is a perspective view of the automatic folding assembly of the invention.
Figure 4:
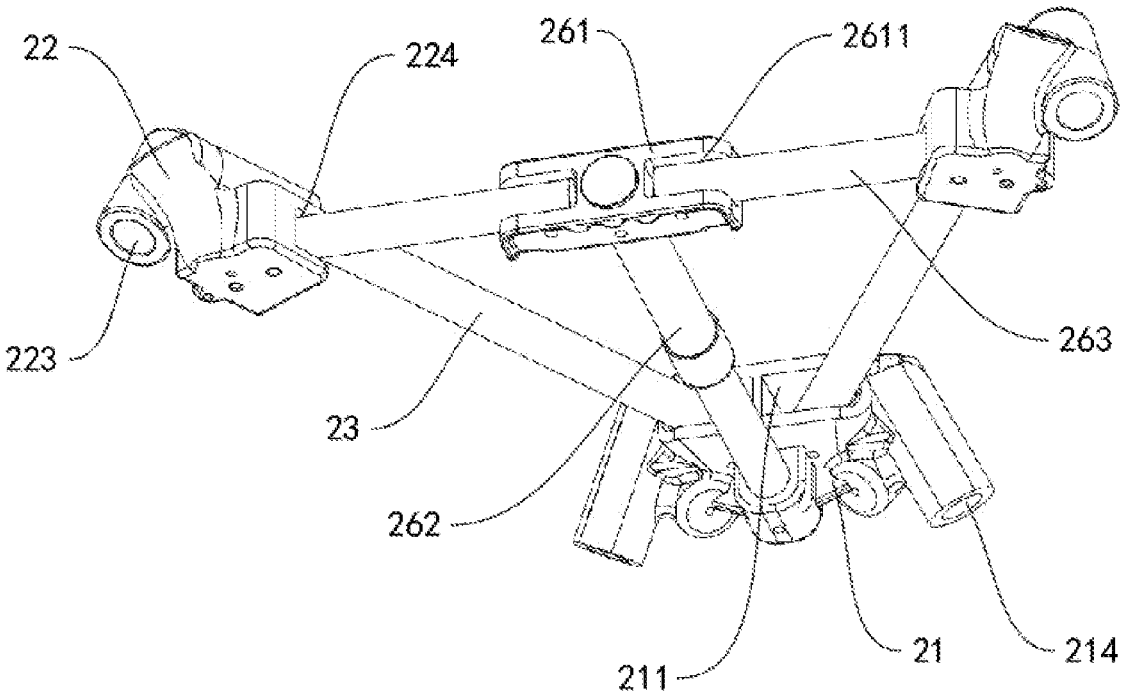
FIG. 4 is a perspective view of the automatic folding assembly of the invention.

In the embodiment, as shown in FIG. 3 and FIG. 4, the rear supporting seat 21 is approximately located at the middle rear side of the two front supporting seats 22; the front side of the rear supporting seat 21 is provided with first grooves 211, and the first groove 211 is provided with a first rotating shaft 212; the rear side of the front supporting seat 22 is provided with first inserting holes 221; one end of the first connecting rod 23 is inserted into the first groove 211, and the first connecting rod 23 is provided with a first rotating hole; when the first connecting rod 23 is inserted into the first groove 211, the first rotating shaft 212 is inserted into the first rotating hole, thereby realizing the rotational connection between the first connecting rod 23 and the rear supporting seat 21; the other end of the first connecting rod 23 is fixedly inserted into the first inserting hole 221, so that the first connecting rod 23 and the front supporting seat 22 will rotate synchronously.

As shown in FIG. 2, FIG. 3, and FIG. 4, the upper side of the rear supporting seat 21 is provided with second inserting holes 213 for inserting the supporting rod 24, and the lower side of the rear supporting seat 21 is provided with third inserting holes 214 for inserting the foot rod 25; the upper side of the front supporting seat 22 is provided with fourth inserting holes 222 for inserting the supporting rod 24, and the lower side of the front supporting seat 22 is provided with fifth inserting holes 223 for inserting the foot rod 25. In order to support the chair seat 1 more firmly and on the ground more firmly, the supporting rod 24 and the foot rod 25 are both inclined, therefore, the corresponding inserting holes are also inclined holes.

Further, a spring wire 27 is connected between the supporting rod 24 and the rear supporting seat 21, between the supporting rod 24 and the front supporting seat 22, between the foot rod 25 and the rear supporting seat 21, and between the foot rod 25 and the front supporting seat 22. In specific implementation, the supporting rod 24 and the foot rod 25 can be hollow rods, and the spring wire 27 is penetrated inside the hollow rod, one end thereof is fixedly connected to the hollow rod, and the other end thereof is fixedly connected to the corresponding supporting seat.

The spring wire 27 is an elastic and deformable rope, which belongs to the existing products and can be directly selected according to the requirements. After the spring wire 27 is provided, the corresponding rod body (the supporting rod 24 or the foot rod 25) can be pulled, so the connection strength between the rod body and the corresponding supporting seat can be improved, which makes the structure of the folding chair frame 2 more stable; when the rod body is disassembled and pulled out from the corresponding supporting seat, the spring wire 27 can connect the rod body again, so that the rod body is not easily lost and is convenient for subsequent assembly.

In the embodiment, as shown in FIG. 3 and FIG. 4, the left and right sides of the adapter 261 are respectively provided with second grooves 2611, and the front supporting seat 22 is provided with third grooves 224; the second groove 2611 is provided with a second rotating shaft 2612, and the third groove 224 is provided with a third rotating shaft 225; one end of the second connecting rod 263 is inserted into the second groove 2611 and is rotatably connected to the second rotating shaft 2612, and the other end thereof is inserted into the third groove 224 and is rotatably connected to the third rotating shaft 225. This rotational connection is similar to the rotational connection between the first connecting rod 23 and the rear supporting seat 21; one end of the second connecting rod 263 is provided with a second rotating hole, and the other end is provided with a third rotating hole; the second rotating shaft 2612 is rotatably connected to the second rotating hole, and the third rotating shaft 225 is rotatably connected to the third rotating hole.

With reference to FIG. 3, in this structural form, the rear supporting seat 21, the front supporting seat 22, and the adapter 261 correspond to the three vertices of a triangle, the first connecting rod 23, the second connecting rod 263 and the telescopic rod 262 correspond to the three sides of a triangle; thus, once the telescopic rod 262 is in a locked state, a steady triangular structure is formed.

In the embodiment, as shown in FIG. 3 and FIG. 4, the telescopic rod 262 comprises a first outer tube body 2621, a first inner tube body 2622, and an elastic piece; one of the first outer tube body 2621 and the first inner tube body 2622 is fixedly connected to the rear supporting seat 21, and the other is fixedly connected to the adapter 261 (here, the first inner tube body 2622 is fixedly connected to the rear supporting seat 21, and the first outer tube body 2621 is fixedly connected to the adapter 261); the first inner tube body 2622 is inserted into the first outer tube body 2621; one end of the elastic piece is fixedly connected to the first inner tube body 2622, and the other end thereof is fixedly connected to the first outer tube body 2621; the specific type of the elastic piece is not limited (for example, a spring, a spring wire 27, etc.), as long as it can generate a shrinking elastic force.

The self-locking piece 264 is a first spring buckle; the first outer tube body 2621 is provided with a first limiting hole, and the first inner tube body 2622 is provided with the first spring buckle; the first spring buckle can be snapped into the first limiting hole and the first spring buckle can be pressed to disengage from the first limiting hole. When the first spring buckle is snapped into the first limiting hole, the telescopic rod 262 is in a locked state, and when the first spring buckle is separated from the first limiting hole, the telescopic rod 262 is in an unlocked state.

Specifically, the nested main structure of the two inner and outer tubes of the telescopic rod 262 is similar to the telescopic structure of the umbrella handle of a folding umbrella; the main difference is that an elastic piece is provided inside the telescopic rod 262, and the first spring buckle is also similar structure of snap buttons for fixing on umbrella handle; such a telescopic fixing structure is relatively common in daily life, and is simple and easy to use; those skilled in the art are already familiar with this structure, so it will not be repeated herein.

In the embodiment, the chair seat 1 is provided with a sleeve, and the supporting rod 24 is detachably inserted into the sleeve, thereby realizing the detachable connection between the two.

Figure 5:
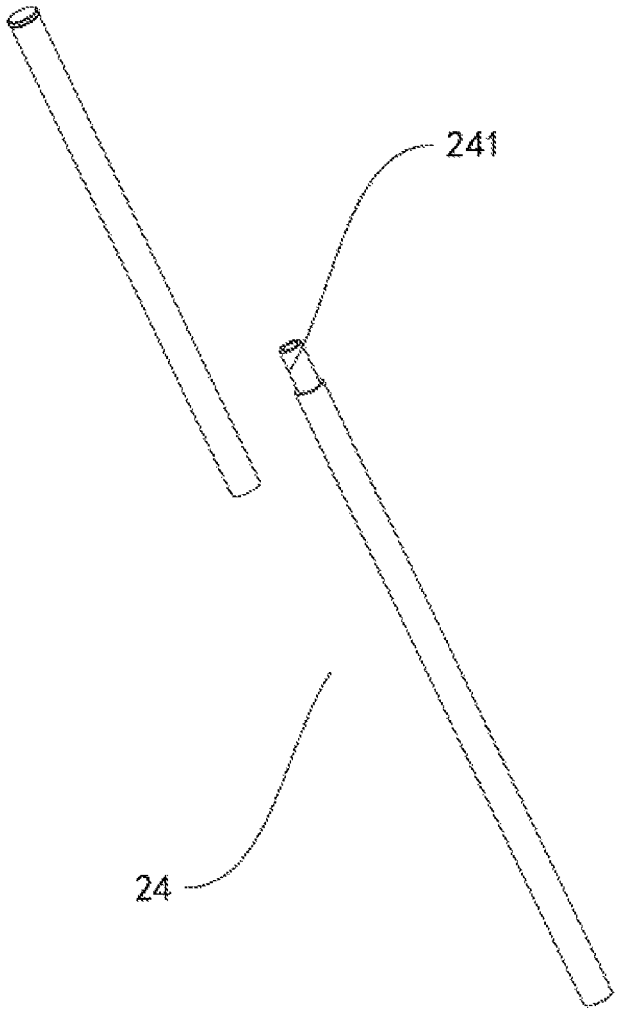
FIG. 5 is an exploded view of the supporting rod of the invention.

In the embodiment, as shown in FIG. 2 and FIG. 5, the supporting rod 24 on the rear supporting seat 21 is a splicing rod. Specifically, since the seatbacks of the chairs are relatively high, when the supporting rods 24 on the rear supporting seat 21 support the seatbacks, the supporting rods 24 need to be relatively long; in order to reduce the folded volume, the supporting rod 24 is made in the form of multi-section splicing; with reference to FIG. 5, the supporting rod 24 herein comprises two hollow tube bodies, the end of one tube body is provided with a inserting part 241, and the inserting part 241 can be inserted into the other hollow tube body; this splicing method is simple and easy to implement. Of course, it can also be designed into a splicing of more than three segments according to requirements, which is not limited herein.

Figure 6:
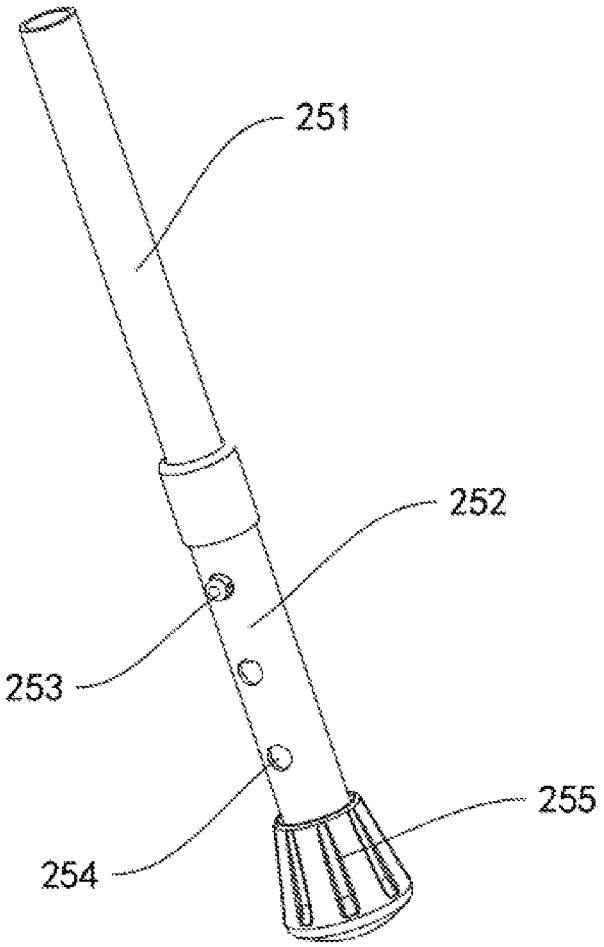
FIG. 6 is a perspective view of the foot rod of the invention.
Figure 7:
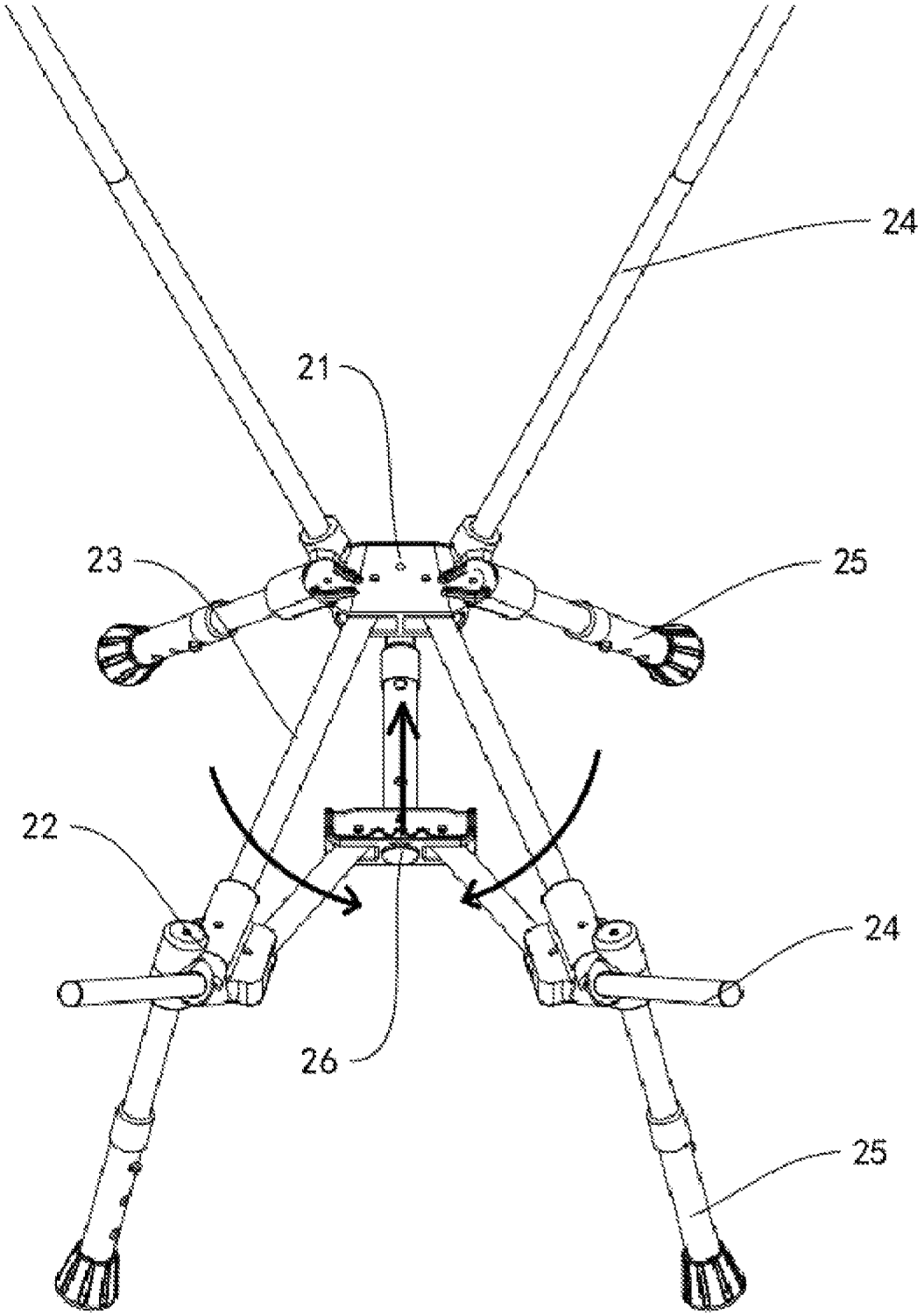
FIG. 7 is a folding schematic diagram of the folding chair frame of the invention.
Figure 8:
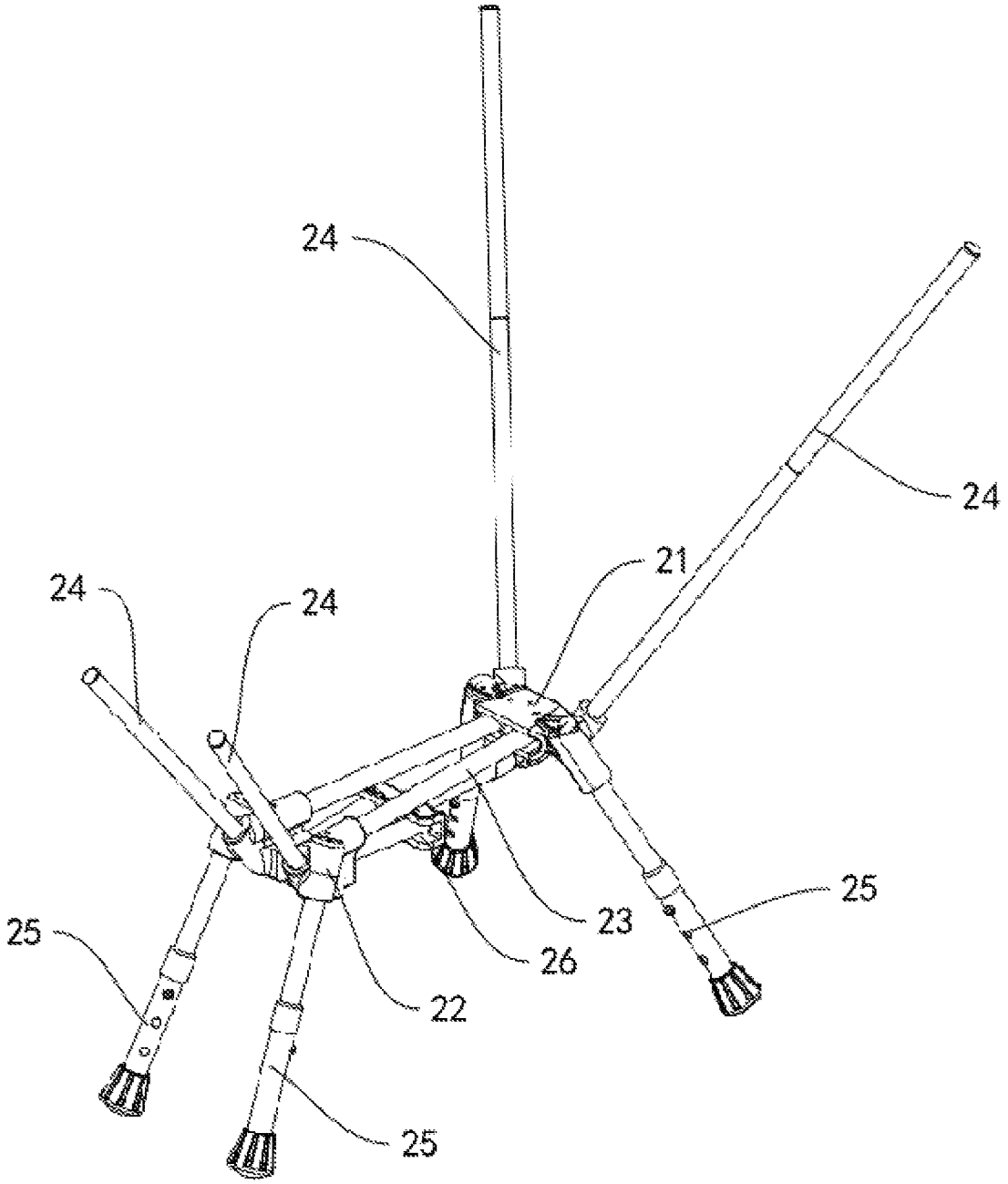
FIG. 8 is a folding schematic diagram of the folding chair frame of the invention.

In the embodiment, as shown in FIG. 6 and FIG. 7, the foot rod 25 is a telescopic piece; therefore, the length of the foot rod 25 can be adjusted according to the requirements, for example, the foot rod 25 can be elongated to increase the height of the chair seat 1, and when folded, the foot rod 25 can be shortened to reduce the volume of the folded seat frame.

There are many telescopic forms of the foot rod 25. For example, with reference to FIG. 6, the foot rod 25 comprises a second outer tube body 252 and a second inner tube body 251; the second outer tube body 252 is provided with a plurality of second limiting holes 254 provided along its axial direction, and the second inner tube body 251 is provided with a second spring buckle 253; the second inner tube body 251 is connected to the front supporting seat 22 or the rear supporting seat 21 and inserted into the second outer tube body 252; the second spring buckle 253 can be snapped into any second limiting hole 254 and the spring buckle can be pressed to disengage from the second limiting hole 254, and this telescopic structure is also similar to the telescopic structure of the umbrella handle of a folding umbrella; details can be found hereinabove.

Further, the bottom of the foot rod 25 is provided with a non-slip mat 255.

It should be noted that this solution does not limit the cross-sectional shape of each rod body used, for example, the cross-sectional shape may be circular, square, or the like.

In summary, the chair of the invention adopts an automatic folding assembly 26 to connect the front and rear supporting seats, and the automatic folding assembly 26 has a locked state and an unlocked state. In the locked state, the automatic folding assembly 26 will be locked and unable to move, which can improve the stability of the chair and ensure the overall safety and physical pressure bearing capacity of the chair; in the unlocked state, the automatic folding assembly 26 will automatically fold, which can simplify the user's operation and improve the convenience of use; with the detachable supporting rod 24 and foot rod 25, it can finally be folded into a smaller storage volume, which improves portability.

Although the embodiments of the invention have been shown and described, for those of ordinary skill in the art, it can be understood that various changes, modifications, and substitutions can be made to these embodiments without departing from the principle and spirit of the invention. The protection scope of the invention is defined by the appended claims and the equivalents thereof.

The invention claimed is:

1. An automatic folding chair, comprising: a chair seat and a folding chair frame, wherein the folding chair frame comprises an automatic folding assembly, a rear supporting seat, and two front supporting seats symmetrically arranged on the left and the right;

the rear supporting seat is rotatably connected with two first connecting rods, and the two first connecting rods are fixedly connected to the two front supporting seats respectively; the rear supporting seat and the front supporting seats are detachably inserted with a foot rod and a supporting rod, and the supporting rod and the chair seat are detachably connected;

the automatic folding assembly comprises an adapter, a telescopic rod, and second connecting rods; the adapter is located between the two front supporting seats; the left and right sides of the adapter are respectively rotatably connected with the second connecting rods, and the two second connecting rods are rotatably connected to the two front supporting seats one by one;

the telescopic rod is an elastic rod that can be axially elongated under external force, axially contracted under its own internal force, or axially contracted under external force, and axially elongated under its own internal force; one axial end of the telescopic rod is fixedly connected to the rear supporting seat, and the other axial end thereof is fixedly connected to the adapter; the telescopic rod is further provided with a self-locking piece, and the self-locking piece has a locked state and an unlocked state; in the locked state, the self-locking piece can restrict the telescopic rod to expand and contract; in the unlocked state, the telescopic rod can actively expand and contract.

2. The automatic folding chair of claim 1, wherein the front side of the rear supporting seat is provided with first grooves, and the first groove is provided with a first rotating shaft; the rear side of the front supporting seat is provided with first inserting holes; one end of the first connecting rod is inserted into the first groove and is rotatably connected to the first rotating shaft, and the other end thereof is fixedly inserted into the first inserting holes.

3. The automatic folding chair of claim 1, wherein the upper side of the rear supporting seat is provided with second inserting holes for inserting the supporting rod, and the lower side of the rear supporting seat is provided with third inserting holes for inserting the foot rod; the upper side of the front supporting seat is provided with fourth inserting holes for inserting the supporting rod, and the lower side of the front supporting seat is provided with fifth inserting holes for inserting the foot rod.

4. The automatic folding chair of claim 1, wherein a spring wire is connected between the supporting rod and the rear supporting seat, between the supporting rod and the front supporting seat, between the foot rod and the rear supporting seat, and between the foot rod and the front supporting seat.

5. The automatic folding chair of claim 1, wherein the left and right sides of the adapter are respectively provided with second grooves, and the front supporting seat is provided with third grooves; the second groove is provided with a second rotating shaft, and the third groove is provided with a third rotating shaft; one end of the second connecting rod is inserted into the second groove and is rotatably connected to the second rotating shaft, and the other end thereof is inserted into the third groove and is rotatably connected to the third rotating shaft.

6. The automatic folding chair of claim 1, wherein the telescopic rod comprises a first outer tube body, a first inner tube body, and an elastic piece; one of the first outer tube body and the first inner tube body is fixedly connected to the rear supporting seat, and the other is fixedly connected to the adapter; the first inner tube body is inserted into the first outer tube body; one end of the elastic piece is fixedly connected to the first inner tube body, and the other end thereof is fixedly connected to the first outer tube body;

the self-locking piece is a first spring buckle; the first outer tube body is provided with a first limiting hole, and the first inner tube body is provided with the first spring buckle; the first spring buckle can be snapped into the first limiting hole and the first spring buckle can be pressed to disengage from the first limiting hole.

7. The automatic folding chair of claim 1, wherein the chair seat is provided with a sleeve, and the supporting rod is detachably inserted into the sleeve.

8. The automatic folding chair of claim 1, wherein the supporting rod on the rear supporting seat is a splicing rod.

9. The automatic folding chair of claim 1, wherein the foot rod is a telescopic piece.

* * * * *